US005486061A

United States Patent [19]

Kakuguchi

[11] Patent Number: 5,486,061

[45] Date of Patent: Jan. 23, 1996

[54] PAPER FEEDING METHOD AND APPARATUS FOR PREVENTING THE DOUBLE FEEDING OF PAPERS

[75] Inventor: Kazuhiro Kakuguchi, Kawasaki, Japan

[73] Assignee: Fujitsu Limited, Kawasaki, Japan

[21] Appl. No.: 178,629

[22] Filed: Jan. 7, 1994

Related U.S. Application Data

[63] Continuation of Ser. No. 572,273, Aug. 24, 1990, abandoned.

[30] Foreign Application Priority Data

Aug. 25, 1989 [JP] Japan ..... 1-219135

[51] Int. Cl.[6] ..... B41J 11/00

[52] U.S. Cl. ..... 400/605; 400/607; 400/708; 400/711; 400/712

[58] Field of Search ..... 400/605, 607, 400/607.2, 608.2, 703, 708, 708.1, 711, 712, 582, 583; 226/110; 271/9, 258, 259

[56] References Cited

U.S. PATENT DOCUMENTS

| | | | |
|---|---|---|---|
| 4,789,258 | 12/1988 | Gomoll et al. | 400/605 |
| 4,909,497 | 3/1990 | Itabashi et al. | 400/605 |
| 4,929,104 | 5/1990 | Yokoi et al. | 400/605 |
| 5,026,183 | 6/1991 | Oshima et al. | 400/605 |
| 5,087,142 | 2/1992 | Suzuki et al. | 400/607.2 |

FOREIGN PATENT DOCUMENTS

| | | | |
|---|---|---|---|
| 49976 | 3/1985 | Japan | 400/605 |
| 62-99171 | 5/1987 | Japan . | |
| 97871 | 5/1987 | Japan | 400/605 |
| 142217 | 6/1988 | Japan | 400/605 |
| 64-27974 | 1/1989 | Japan . | |

*Primary Examiner*—Stephen Funk

*Attorney, Agent, or Firm*—Armstrong, Westerman, Hattori, McLeland, & Naughton

[57] ABSTRACT

In a paper feeding method and an apparatus therefor, papers are selectively fed to a paper-processing station through at least two paper guide paths. The respective papers fed through the paper guide paths are monitored to determine whether or not a double feeding of the papers has occurred, and when a double feeding of the papers is detected, an alarm warning of the occurrence of a double feeding of the papers is raised.

27 Claims, 9 Drawing Sheets

CPU
ROM
RAM
I/O
A/D
A/D
DRIVER CIRCUIT
DRIVER CIRCUIT
MOTOR
ALARM 82
82a
CPU
82b
ROM
RAM
82c
82d
I/O
92
A/D
A/D
A/D
106
104
84
DRIVER CIRCUIT
DRIVER CIRCUIT
96
98
MOTOR
ALARM
28
94
74
88
88a
76
74
54
64
56a
56a
50
58
56a
56a
52
44
78
48
102a
42
100
100a
102
46
80
12
12a
18
16

PAPER FEEDING ROUTINE

C ← 1 + C
701
702
IS SW 102 "ON" ?
NO
YES
705
IS SW 88 "ON" ?
YES
NO
709
C ≦ Ns ?
NO
YES
703
IS SW 100 "ON" ?
NO
YES
704
C ≧ NM ?
NO
YES
711
C ≦ Nc ?
NO
YES
713
DISPLAY ERROR
710
MOTOR 28 IS MADE "OFF"
712
MOTOR 28 IS MADE "OFF"
714
MOTOR 28 IS MADE "OFF"
715
C ← 0
706
MOTOR 28 IS MADE "OFF"
707
ALARM 94 IS MADE "ON"
C ← 0
708
RETURN

PAPER FEEDING METHOD AND APPARATUS FOR PREVENTING THE DOUBLE FEEDING OF PAPERS

This application is a continuation application of Ser. No. 07/572,273 filed Aug. 24, 1990, now abandoned.

BACKGROUND OF THE INVENTION

1) Field of the Invention

The present invention relates to a paper feeding method and an apparatus therefor, wherein papers are selectively fed to a paper-processing station through at least two paper guide paths. The present invention also relates to a printer in which such a paper feeding apparatus is incorporated.

2) Description of the Related Art

Unexamined Japanese Patent Publication (KOKAI) No. 62(1987)-99171 discloses a printer having a paper feeding apparatus incorporated therein, which comprises first and second paper guide paths for selectively feeding a continuous form paper and a cut sheet paper, respectively, to a printing position defined by a platen and a printing head of the printer, and a mechanical switching system for selecting one of the first and second paper guide paths so that a double feeding of the papers to the printing position can be prevented.

The first paper guide path for the continuous form paper is formed of a guide plate member disposed between the platen and a pin-belt tractor in which the continuous form paper to be fed is set. As is well known, the pin-belt tractor includes a pair of endless belts having a plurality of pin elements which are engageable with two rows of perforations formed along the side margins of the continuous form paper. By driving the pin-belt tractor, the continuous form paper is fed to the printing position through the first paper guide path. The platen and the pin-belt tractor are driven by a common drive motor, but the operative connection between the pin-belt tractor and the platen can be selectively cut by the mechanical switching system.

The second paper guide path is formed by partially applying a guide member to the platen, and joins the first paper guide path at a location adjacent to the platen. The cut sheet paper is manually introduced into the second paper path, and is then fed to the printing position by a pressure roller resiliently pressed against the platen driven by the motor. In particular, a leading edge of the introduced cut sheet paper is abutted against a nip between the platen and the pressure roller, and the cut sheet paper is passed through the nip due to the rotation of the platen, whereby a feeding of the cut sheet paper to the printing position can be carried out. The pressure roller can be selectively separated from the platen by the mechanical switching system.

The mechanical switching system includes a switching lever which is movable between first and second positions. When the switching lever is at the first position, the pressure roller is separated from the platen so that, even though the cut sheet paper is introduced into the second paper guide path, the feeding of the cut sheet paper to the printing position is prevented. Also, when the switching lever is at the first position, the operative connection between the pin-belt tractor and the drive motor is established so that only the feeding of the continuous form paper to the printing position is ensured. On the contrary, when the switching lever is at the second position, the pressure roller is resiliently pressed against the platen, and the operative connection between the pin-belt tractor and the drive motor is cut, whereby only the feeding of the cut sheet paper to the printing position is ensured.

The paper feeding apparatus as mentioned above is complex and costly, because the mechanical switching system thereof must be constructed by many mechanical parts or elements. Especially, the assembly of a mechanical arrangement for separating the pressure roller from the platen is troublesome due to a coextension of the pressure roller with the platen, resulting in a rise in cost of the assembly thereof.

SUMMARY OF THE INVENTION

Therefore, an object of the present invention is to provide a paper feeding apparatus for selectively feeding papers to a paper-processing station through at least two paper guide paths, which can be constituted so that a mechanical arrangement is eliminated therefrom as much as possible, and that, even if a double feeding of the papers inadvertently occurs, an operator can be made immediately aware of the occurrence of the double feeding of the papers.

Another object of the present invention is to provide a paper feeding method of selectively feeding papers to a paper-processing station, which can be embodied in such a manner that a mechanical arrangement is eliminated therefrom as much as possible, and that, even if a double feeding of the papers inadvertently occurs, an operator can be made immediately aware of the occurrence of the double feeding of the papers.

Yet another object of the present invention is to provide to a printer in which the paper feeding apparatus as mentioned above is incorporated.

In accordance with the present invention, there is provided a paper feeding apparatus for selectively feeding papers to a paper-processing station through at least a first paper guide path and a second paper guide path, which comprises: first feeder means for feeding the paper through the first paper guide path to the paper-processing station; second feeder means for feeding the paper through the second paper guide path to the paper-processing station; monitor means for monitoring the respective papers fed by the first and second feeder means to the paper-processing station through the first and second paper guide paths, to generate a signal indicating an occurrence of a double feeding of the papers; and alarm means for raising an alarm up on the occurrence of a double feeding of the papers, on the basis of the signal generated by the monitor means.

According to an aspect of the present invention, the monitor means comprises: first signal generation means for generating a signal indicating which of the first and second paper guide paths is selected for the feeding of the paper; detection means for detecting the paper fed thereto, at a location between the paper-processing station and the joining location of the first and second paper guide paths, to generate a signal indicating a detection of the paper, the paper fed from the first feeder means being detected by the detection means at a time different from a time at which the paper fed from the second feeder means is detected by the detection means; first determination means for determining through which of the first and second guide paths the paper is being fed, on the basis of a comparison of the signal generated by the detection means with a reference time; second determination means for determining whether or not a determination carried out by the first determination means disagrees with the signal generated by the first signal generation means; and second signal generation means for generating the signal indicating the occurrence of the double feeding of the papers when a disagreement between the determination carried out by the first determination means and the signal generated by the first signal generation means is determined by the second determination means.

According to another aspect of the present invention, the monitor means comprises: first signal generation means for generating a signal indicating which of the first and second paper guide paths is selected for the feeding of the paper; first detection means associated with the first feeder means for detecting the paper fed thereto, to generate a signal indicating a detection of the paper; second detection means associated with the second feeder means for detecting the paper fed thereto, to generate a signal indicating a detection of the paper; determination means for determining whether or not the signal generated by the first signal generation means disagrees with a signal obtained from one of the first and second detection means; and second signal generation means for generating a signal indicating the occurrence of the double feeding of the papers when a disagreement between the signal generated by one of the first and second detection means and the signal generated by the first signal generation means is determined by the determination means.

According to yet another aspect of the present invention, the monitor means comprises: first detection means associated with the first feeder means for detecting the paper fed thereto, to generate a signal indicating a detection of the paper; second detection means associated with the second feeder means for detecting the paper fed thereto, to generate a signal indicating a detection of the paper; determination means for determining whether or not two signals are generated by the first and second detection means, respectively; and second signal generation means for generating a signal indicating an occurrence of a double feeding of the papers when the generation of the respective signals by the first and second detection means is determined by the determination means.

Also, in accordance with the present invention, there is provided a paper feeding method of selectively feeding papers through at least first and second paper guide paths to a paper-processing station, wherein the respective papers fed through the first and second paper guide paths to the paper-processing station are monitored to generate a double feed signal indicating an occurrence of a double feeding of the papers; and an alarm warning of the occurrence of the double feeding of the papers is raised on the basis of the double feeding signal.

BRIEF DESCRIPTION OF THE DRAWINGS

The objects and advantages of the present invention will be better understood from the following description, with reference to the accompanying drawings, in which.

DESCRIPTION OF THE PREFERRED EMBODIMENT

Figure 1:
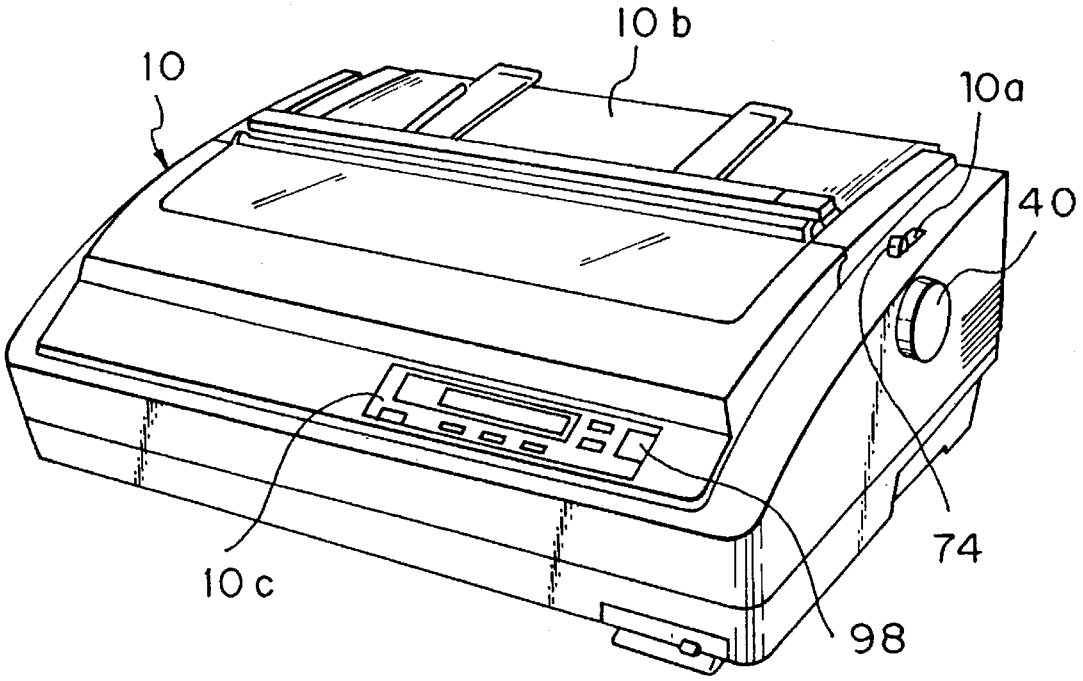
FIG. 1 is a perspective view showing a printer having a paper feeding apparatus incorporated therein.
Figure 2:
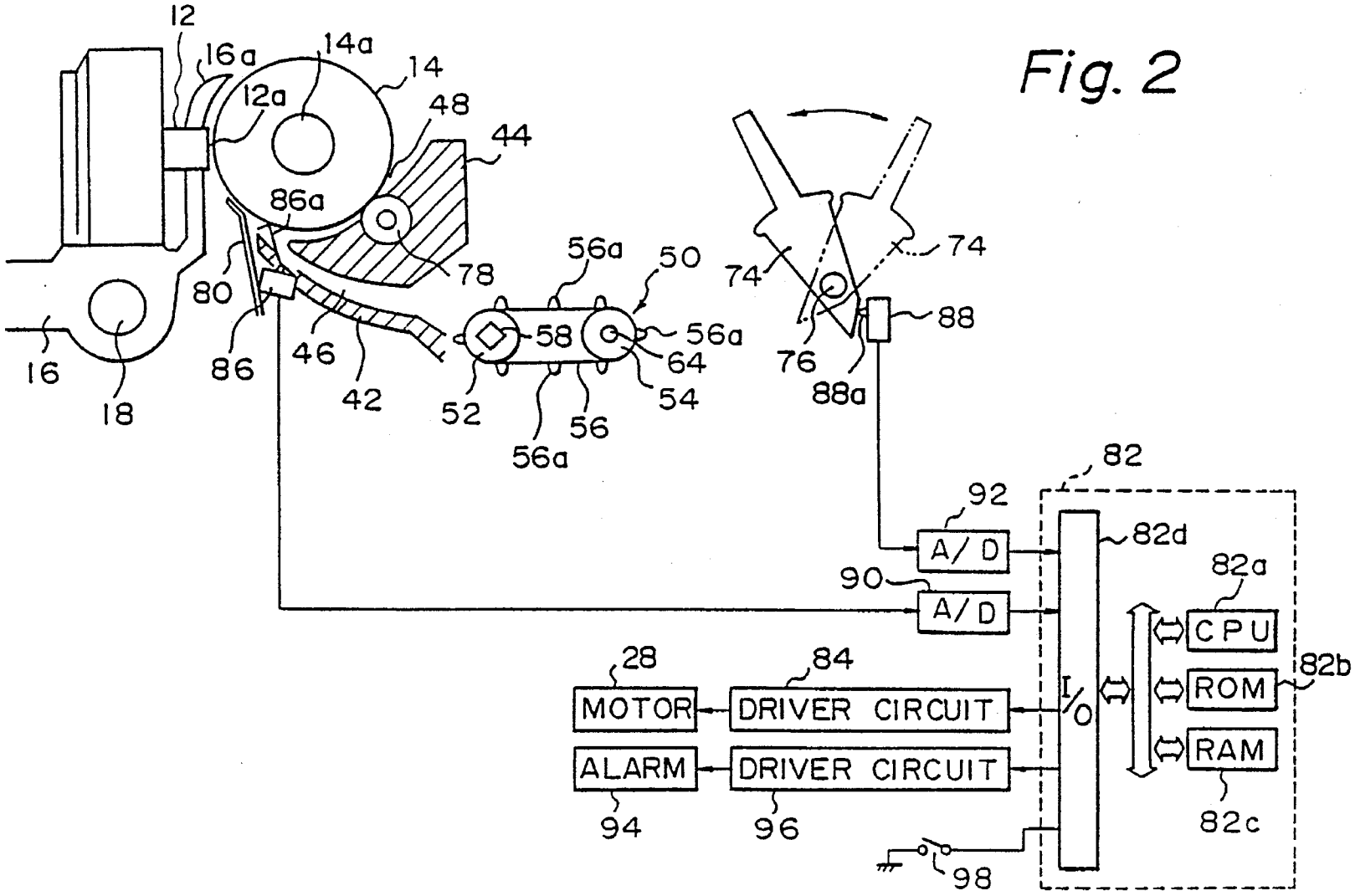
FIG. 2 is a schematic diagram of an embodiment of a paper feeding apparatus incorporated into the printer of FIG. 1.

FIG. 1 is a perspective view of a wire dot printer in which the present invention is embodied, and FIG. 2 schematically and diagrammatically shows a paper feeding apparatus according to the present invention when applied to the printer. The printer comprises a cover casing 10 in which a printer frame (not shown), a printing head 12, a platen 14, etc., are housed. The printing head 12 is mounted on a carriage 16, which is movable along a guide rod 18 supported by the printer frame and is driven by a suitable drive mechanism (not shown). The platen 14 is disposed in parallel with the path of the movement of the printing head 12, in such a manner that a printing face 12*a* of the printing head 12 is close to a surface of the platen 14. The carriage 16 has a guide arm 16*a* extended therefrom so that a paper to be printed is guided along the platen surface while being passed through a printing position, i.e., a gap between the printing face 12*a* and the platen surface.

Figures 3A, 3B:
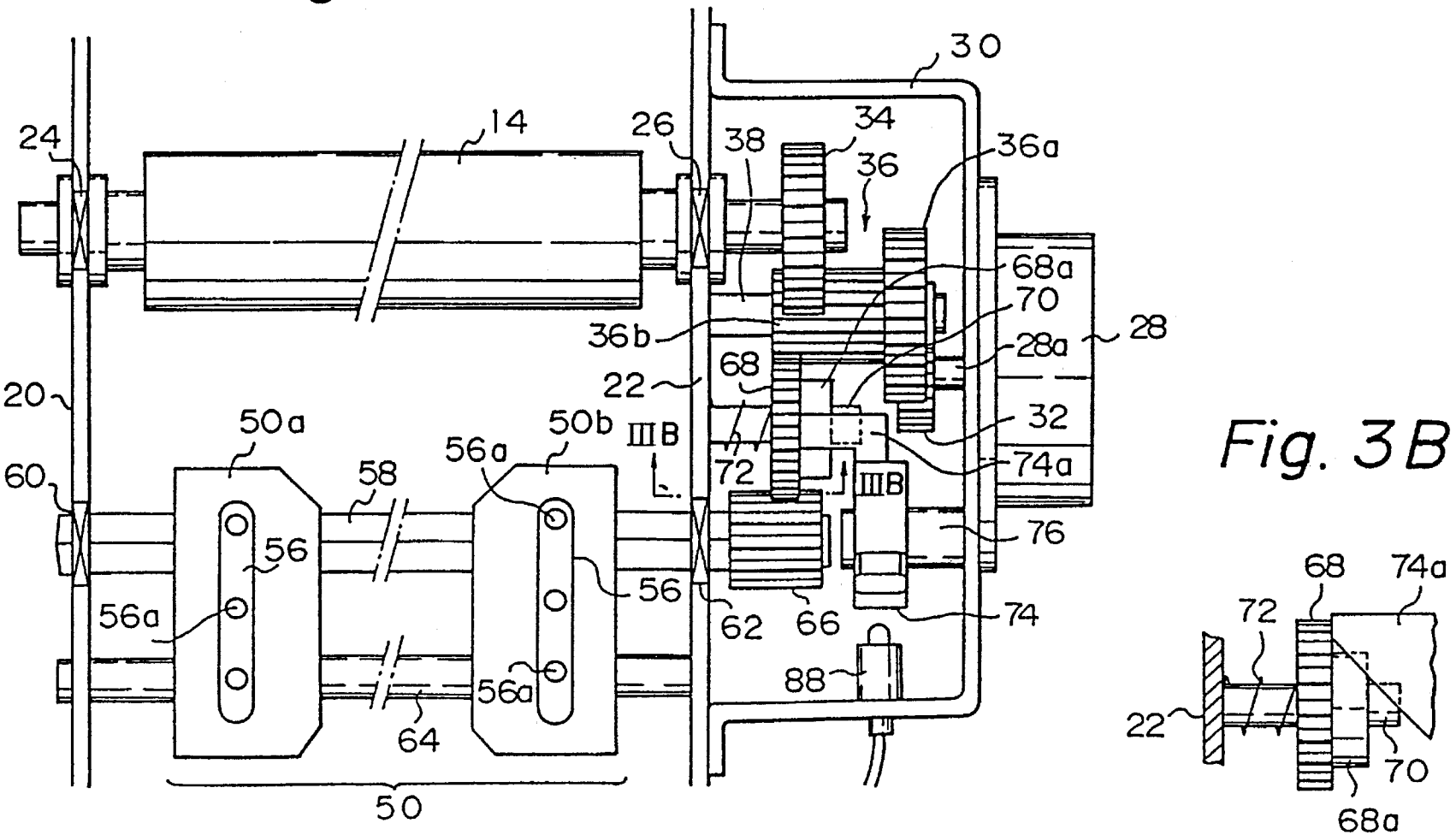
FIG. 3A is an enlarged schematic plan view of a platen, a pin-belt tractor, a transmission mechanism, and a drive motor, etc., forming parts of the printer of FIG. 1, showing an operative connection established between the pin-belt tractor and the drive motor.
FIG. 3B is a partial sectional view taken along a line III—III in FIG. 3A.
Figures 4A, 4B:
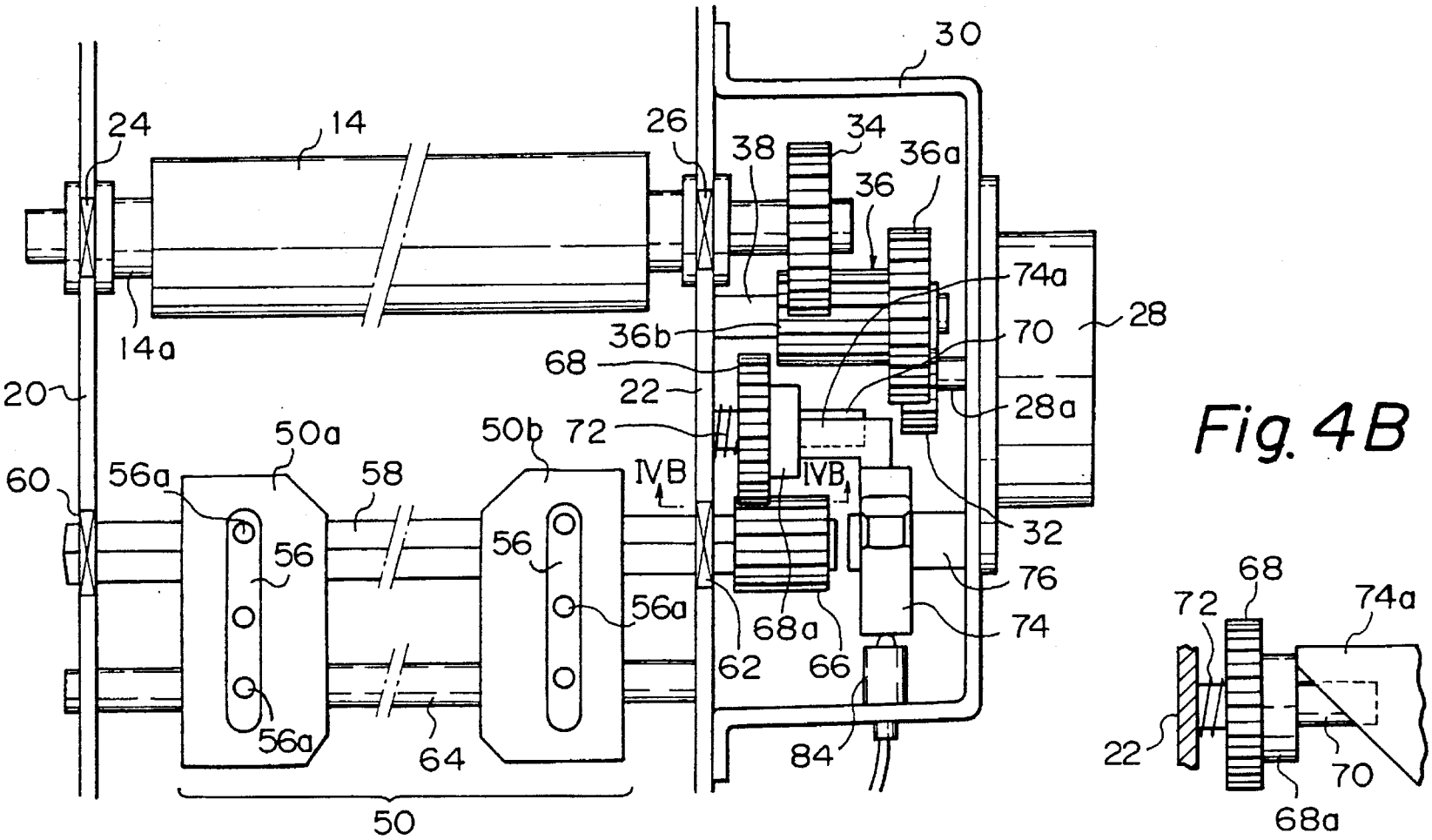
FIG. 4A is a view identical to FIG. 3A, except that it shows the operative connection between the pin-belt tractor and the drive motor when cut.
FIG. 4B is a partial sectional view taken along a line IV—IV in FIG. 4A.

Referring to FIGS. 3A and 4B, side walls of the printer frame are partially shown, and are indicated by reference numerals 20 and 22. A shaft 14*a* of the platen 14 is rotatably supported by the side walls 20 and 22 of the printer frame through the intermediary of suitable bearing 24 and 26. The platen 14 is rotated by a drive motor 28 such as a pulse motor, a servo motor or the like, supported by a frame member 30 attached to the side wall 22 of the printer frame. To this end, a drive shaft 28*a* of the motor 28 and an end of the platen shaft 14*a* have gears 32 and 34 securely mounted thereon, respectively, and these gears 32 and 34 are operatively connected to each other through the intermediary of a double gear 36, which is rotatably mounted on a shaft 38 projected from the side wall 22 of the printer frame. Namely, the double gear 36 has large and small gear portions 36*a* and 36*b* engaged with the gears 32 and 34, respectively, whereby the rotation of the platen 14 can be carried out. The other end of the platen shaft 14*a* is projected through a side wall of the cover casing 10, and has a manual knob 40 securely mounted thereon, as shown in FIG. 1. Note, in FIG. 2, the motor 28 is shown merely as a block.

In this embodiment, the paper feeding apparatus according to the present invention comprises a guide plate 42 and a guide member 44, which are associated with each other to form a first paper guide path 46. The guide member 44 is also associated with the platen 14 to form a second paper guide path 48. The first paper guide path 46 joins the second paper guide path 48 at a location adjacent to the platen 14, as shown in FIG. 2, and the first and second paper guide paths 46 and 48 are used to lead a continuous form paper and a cut sheet paper to the printing position.

The paper feeding apparatus also comprises a pin-belt tractor 50 for feeding the continuous form paper to the printing position, along the first paper guide path 46. As shown in FIGS. 3A and 4A, the pin-belt tractor 50 includes a pair of pin-belt assemblies 50*a* and 50*b*, each of which has a set of drive and driven pulleys 52 and 54 and an endless belt 56 entrained therebetween. The drive pulley 52 is slidably mounted on a square cross-sectional rod 58 rotatably supported by the side walls 20 and 22 of the printer frame through the intermediary of bearings 60 and 62, and the driven pulley 54 is slidably and rotatably mounted on a round cross-sectional rod 64 securely supported by the side walls 20 and 22 of the printer frame. Note, the drive pulleys 52 are selectively driven by the motor 28 for the platen 14, as discussed hereinafter in detail. The endless belt 56 has a plurality of pin elements 56*a* projected from an outer surface thereof and aligned with each other at regular intervals. In each of the pin-belt assemblies 50*a* and 50*b*, the aligned pin elements 56*a* have the same pitch as that of aligned perforations formed along one of the side margins of the continuous form paper. With this arrangement, the continuous form paper can be set in the pin-belt tractor 50 in such a manner that the two rows of the pin elements 56*a* are received in the two rows of perforations formed along the side margins of the continuous form paper.

The square cross-sectional rod 58 is provided with a gear 66 securely mounted on an end thereof. The gear 66 can be operatively connected to the small gear portion 36*b* of the double gear 36 through the intermediary of a middle gear 68, which is slidably mounted on a rod member 70 projected from the side wall 22 of the printer frame. The middle gear 68 is movable between a first position shown in FIG. 3A and a second position shown in FIG. 4A, over the rod member 70, and is resiliently biased toward the first position of FIG. 3A by a compressed coil spring 72 mounted on the rod member 70 and constrained between the middle gear 68 and the side wall 22 of the printer frame. The movement of the middle gear 68 from one of the first and second positions to the other position thereof is carried out by a switching lever 74, which is pivotally mounted on a rod member 76 supported by the frame member 30 and is pivotally moved between a first position shown in FIG. 3A and a second position shown in FIG. 4A. In particular, the switching lever 74 has a cam member 74*a* integrally formed therewith, which is engageable with the middle gear 68 and a spacer disk member 68*a* integrally and concentrically formed therewith. When the switching lever 74 is at the first position of FIG. 3A, the middle gear 68 is abutted against the cam member 74*a* due to the resilient force of the compressed coil spring 72, as shown in FIGS. 3A and 3B, so that the middle gear 68 is maintained at the first position of FIG. 3A to establish the operative connection between the gear 66 and the small gear portion 36*b* of the double gear 36. When the switching lever 74 is pivotally moved from the first position of FIG. 3A to the second position of FIG. 4A, the middle gear 68 is also moved from the first position of FIG. 3A to the second position of FIG. 4A, against the resilient force of the compressed coil spring 72, so that the cam member 74*a* is engaged with a side face of the spacer disk member 68*a*, as shown in FIGS. 4A and 4B, whereby the operative connection between the gear 66 and the small gear portion 36*b* of the double gear 36 is cut. Namely, the continuous form paper must be set in the pin-belt tractor 50 and the switching lever 74 must be positioned at the first position of FIG. 3A, before the feeding of the continuous form paper to the printing position can be performed. Note, as shown in FIG. 1, the switching lever 74 is projected out of the cover housing 10 through a slot 10*a* formed therein, so that it can be manually operated by an operator.

Note, preferably the pulleys 52 and 54 are toothed pulleys, and the endless belt 56 has teeth formed over the inner surface thereof and engaged with the teeth of the pulleys 52 and 54, whereby the endless belt 56 can be driven by the pulleys 52 and 54 without slippage therebetween.

The paper feeding apparatus further comprises a pressure roller 78 which is in contact with the platen 14 and feeds the cut sheet paper to the printing position along the second paper guide path 48. In this embodiment, the cut sheet paper is manually introduced into the second guide path 48 along a guide tray 10*b* (FIG. 1) provided in the cover casing 10 in such a manner that a leading edge of the cut sheet paper is abutted against a nip between the platen 14 and the pressure roller 78. Even though the guide tray 10*b* is shown at a horizontal position in FIG. 1, it is pivoted to the printer frame at a front side thereof so as to be raised from the horizontal position to a slanted position, to thereby provide a slanted guide surface for the cut sheet paper to be introduced into the second guide path 48. After the cut sheet paper is manually introduced, the platen 14 is driven by the motor 28, whereby the cut sheet paper is fed to the printing position. Note, in FIG. 2, reference numeral 80 designates a guide plate for ensuring that a leading edge of the paper is led to the printing position.

The paper feeding apparatus further comprises a control circuit 82 by which a driver circuit 84 for the motor 28 is controlled so that the continuous form paper or the cut sheet paper is accurately fed to the printing position. In this embodiment, the control circuit 82 may be constructed by a microcomputer, as shown in FIG. 2, which includes a central processing unit (CPU) 82*a*, a read-only memory (ROM) 82*b* for storing routines, constants, etc., a random access memory (RAM) 82*c* for storing temporary data, and an input/output interface (I/O) 82*d*.

In the paper feeding apparatus mentioned above, the continuous form paper and the cut sheet paper may be simultaneously fed to the printing position due to an inadvertent manipulative mistake by an operator. Namely, although the continuous form paper is set in the pin-belt tractor 50, and the switching lever 74 is at the first position (FIGS. 3A and 3B), the cut sheet paper may be inadvertently introduced into the second guide path 48. In this case, if the motor 28 is actuated, not only is the platen 14 rotated, but also the pin-belt tractor 50 is driven, resulting in a simultaneous or double feeding of the continuous form paper and cut sheet paper. Note, the double feeding of the papers must be avoided because a proper printing cannot be carried out, and further, the printing head 12 may be damaged.

For this reason, the paper feeding apparatus further comprises a monitor and alarm system for warning the operator of an occurrence of the double feeding of the papers. This monitor and alarm system includes a detector 86 for detecting a passage of the paper at the location where the second paper guide path 48 joins the first paper guide path 46. As apparent from FIG. 2, the detecter 86 may be formed as a contact switch 86 having a leaf spring 86*a*. This contact switch 86 is usually OFF. When the leaf spring 86*a* is depressed by the paper passing through the joining location of the first and second paper guide paths 46 and 48, the contact switch 86 is turned ON and an output signal thereof is changed from a low level to a high level. The monitor and alarm system also includes a detector 88 for detecting whether the switching lever 74 is at the first (FIG. 3A) or second position (FIG. 4A). The detector 88 is also formed as a contact switch having a detecting projection 88A, and is attached to the frame member 30 to be actuated by the switching lever 74, as shown in FIGS. 3A and 4A. In particular, when the switching lever 74 is moved from the first position to the second position so that the detecting projection 88A is depressed by the engagement with the switching lever 74, the contact switch 88 is turned ON and an output signal thereof is changed from a low level to a high level. Note, in FIG. 2, the switching lever 74 is at the first position, as shown by a phantom line, and the switching lever 74 is at the second position, as shown by a solid line. The signals output from the detectors 86 and 88 are fetched as digital data by the control circuit 82 through analog-to digital (A/D) convertors 90 and 92, respectively, and the fetched data is processed to determine whether or not a double feeding of the papers has occurred. The monitor and alarm system further includes a suitable audio or visible alarm 94, and a driver circuit 96 therefor, which is energized by the control circuit 82 when the double feeding of the papers occurs.

The control circuit 82 is provided with a load switch 98 disposed in a panel board 10*c* mounted on the cover casing 10, as shown in FIG. 1. After the continuous form paper is set in the pin-belt tractor 50 or after the cut sheet paper is introduced into the second guide path 48 in the above-mentioned manner, the load switch 98 is depressed by the operator so that the paper feeding apparatus is operated.

The operation of the paper feeding apparatus will be explained with reference to a paper feeding routine shown in FIG. 5.

In this embodiment, the operation is carried out under the following condition:

$T_s<T_c$ wherein $T_s$ is a time elapsing until a leading edge of the cut sheet paper is detected by the leaf spring 86*a* of the contact switch 86; and $T_c$ is a time elapsing until a leading edge of the continuous form paper is detected by the same. Note, $T_s$ is shorter than $T_c$. In other words, in order to monitor an occurrence of the double feeding of the papers, the paper feeding apparatus shown in the applicant's FIG. 2 is arranged such that the cut sheet paper reaches the contact switch 86 before the continuous form paper ($T_s<T_c$), and the number $N_o$ is predetermined so that it is larger than a number corresponding to the time $T_s$, but is smaller than a number corresponding to $T_c$.

Figure 5:
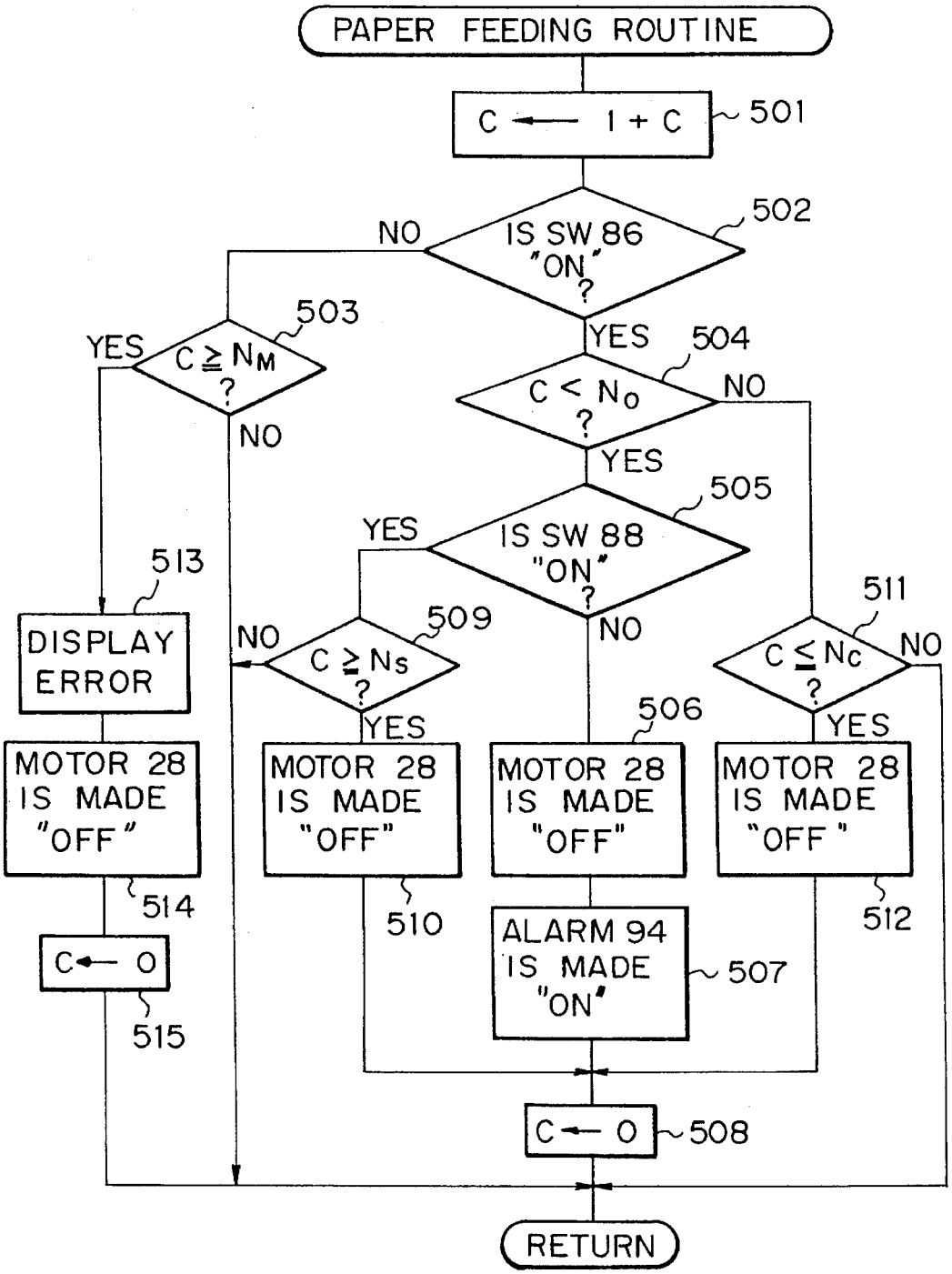
FIG. 5 is a flow chart for explaining an operation of the embodiment shown in FIG. 2.

The paper feeding routine of FIG. 5 is executed by interruptions output at very short intervals on the order of milli-seconds, which intervals are preferably based upon a frequency of the drive pulses output from the driver circuit 84 to the motor 28. In this case, when the motor 28 is driven by depressing the load switch 98, i.e., when the drive pulses are output from the driver circuit 84 for the motor 28, an execution of the paper feeding routine is started.

At step 501, a counter C, which is initially made "0", is incremented by 1. Then, at step 502, it is determined whether or not the contact switch 86 is turned ON. At this stage, since the contact switch 86 can not detect either the continuous form paper or the cut sheet paper, it is OFF, and thus the control proceeds to step 503 in which it is determined whether or not a count number of the counter C has reached a number $N_M$. This number $N_M$ is larger than a number corresponding to the time $T_C$. At this stage, since $C<N_M$, the routine is once completed, and thereafter, the routine is repeatedly executed but the counter C is only incremented by 1 until the contact switch 86 is turned ON, i.e., one of the cut sheet paper and the continuous form paper is detected thereby.

At step 502, if the contact switch 86 is turned ON, one of the cut sheet paper and the continuous form paper has been fed toward the printing position, and thus the control proceeds to step 504 in which a count number of the counter C is compared with a number $N_o$. This number $N_o$ is larger than a number corresponding to the time $T_s$, but is smaller than a number corresponding to the time $T_c$. Accordingly, when the counter number of the counter C is smaller than the number $N_o$, it is determined that the contact switch 86 has been turned ON by the cut sheet paper. Conversely, when the counter number of the counter C is larger than the number $N_o$, it is determined that the contact switch 86 has been turned ON by the continuous form paper.

At step 504, if $C<N_o$, the control proceeds to step 505 in which it is determined whether the contact switch 88 is ON or OFF. If the contact switch 88 is OFF, it is determined that the switching lever 74 is at the first position (FIG. 3A) and the continuous form paper also may be fed from the pin-belt tractor 50, to result in a possible occurrence of a double feeding of the papers. Accordingly, the control proceeds to step 506 in which the driver circuit 84 is de-energized so that the motor 28 is turned OFF, whereby neither the continuous form paper nor the cut sheet paper can be fed to the printing position.

At step 507, the driver circuit 96 is energized so that the alarm 94 is turned ON, whereby the operator is made aware that the proper position (i.e., the second position) of the switching lever 74 has not been selected. The control then proceeds to step 508, in which the counter C is reset, and the routine is ended.

At step 505, if the contact switch 88 is ON, it is determined that the switching lever 74 is at the second position, and thus the second paper guide path 48 is selected for a printing of the cut sheet paper. Thereafter, the control proceeds to step 509 in which it is determined whether or not a count number of the counter C has reached a number $N_s$. This number $N_s$ corresponds to a time elapsing until the cut sheet paper reaches the printing position. At this stage, since $C<N_s$, the routine is once completed, and thereafter, the routine is repeatedly executed but the counter C is only incremented by 1 until a count number thereof reaches the number $N_s$.

At step 509, if the count number of the counter C reaches the number $N_s$, i.e., if the cut sheet paper is fed to the printing position, the control proceeds to step 510 in which the motor 28 is turned OFF. The control then proceeds to step 508 in which the counter C is reset, and the routine is ended. Thereafter, a printing routine is executed by, for example, depressing a printing switch on the panel board 10*c*, and a printing of the cut sheet paper is carried out on the basis of image data output from a word processor or a computer.

At step 504, if $C>N_o$, it is determined that the contact switch 86 has been turned ON by the continuous form paper, and further, that the switching lever 74 is at the first position (FIG. 3A) and the first paper guide path 46 has been properly selected for a printing of the continuous form paper. Thereafter, the control proceeds to step 511, in which it is determined whether or not a count number of the counter C reaches a number $N_c$. This number $N_c$ corresponds to a time elapsing until the continuous form paper reaches the printing position. At this stage, since $C<N_C$, the routine is once completed, and thereafter, the routine is repeatedly executed but the counter C is only incremented by 1 until a count number thereof reaches the number $N_C$.

At step 511, if the count number of the counter C reaches the number $N_C$, i.e., if the continuous form paper is fed to the printing position, the control proceeds to step 512 in which the motor 28 is turned OFF. The control then proceeds to step 508 in which the counter C is reset, and the routine is ended. Thereafter, a printing routine is executed by, for example, depressing a printing switch on the panel board 10*c*, and a printing of the continuous form paper is carried out on the basis of image data output from a word processor or a computer.

At step 503, if a count number of the counter C reaches the number $N_M$, it is determined that the continuous paper has not been set in the pin-belt tractor 50, and further, the cut sheet paper has not been introduced into the second guide path 48. Accordingly, the control proceeds to step 512 in which, for example, an error is displayed on a display of the word processor computer, whereby the operator is made aware that there is no paper to be fed. At step 514, the motor 28 is turned OFF, and the control then proceeds to step 515 in which the counter C is reset, and the routine is ended.

In the embodiment of FIG. 2, although the continuous form paper or the cut sheet paper is detected by the contact switch 86 at the joining location of the first and second paper guide paths 46 and 48, the continuous form paper and the cut sheet paper may be detected at two locations upstream of the joining location of the paper guide paths 46 and 48 by a contact switch with two detecting elements incorporated into the guide member 44 in such a manner that the two detecting elements are extended into the paper guide paths 46 and 48, respectively.

Figure 6:
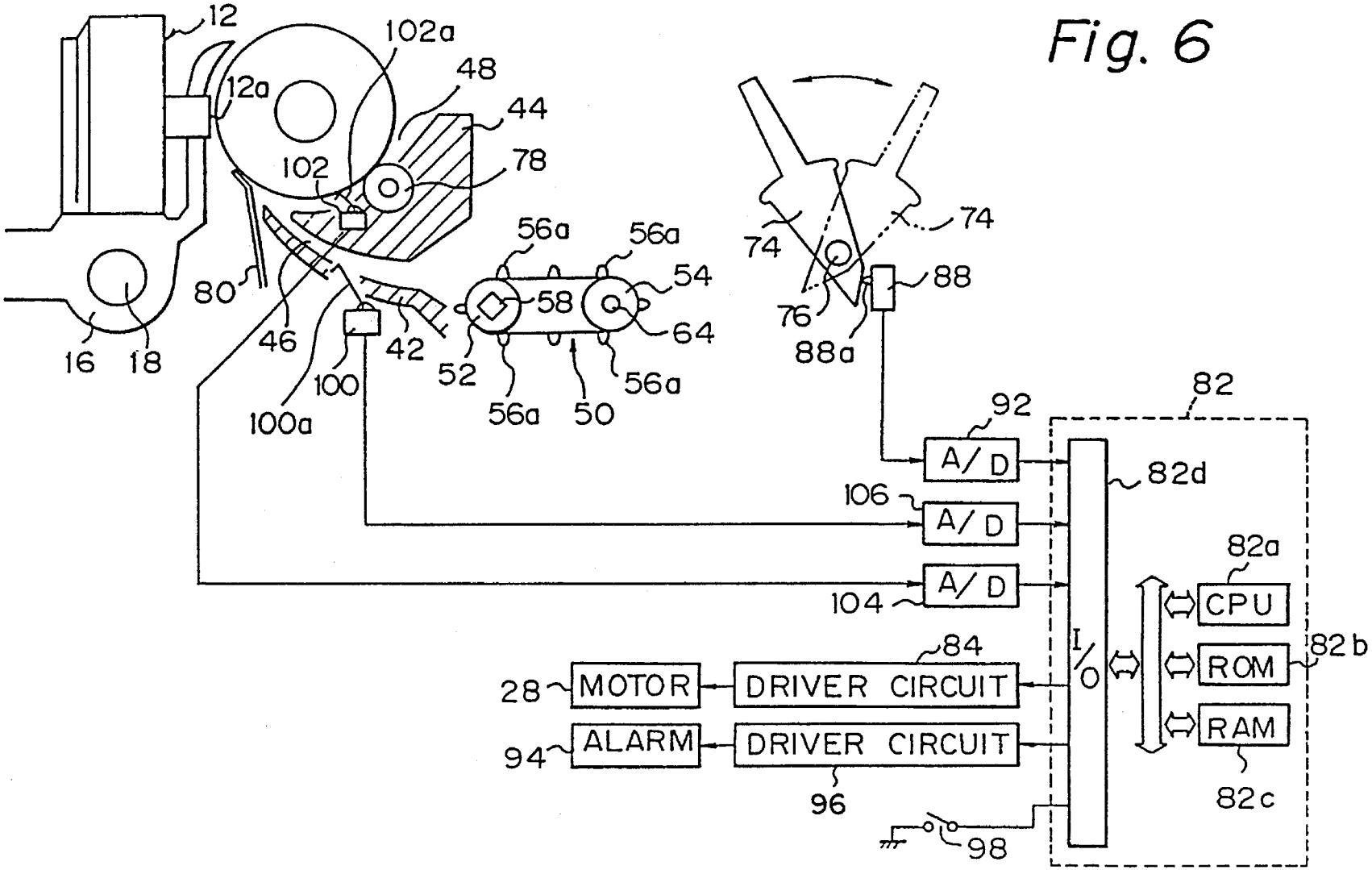
FIG. 6 is a schematic diagram of another embodiment of a paper feeding apparatus according to the present invention.

FIG. 6 shows another embodiment of the paper feeding apparatus according to the present invention, which is substantially identical to the embodiment of FIG. 2 except that two contact switches 100 and 102 are associated with the first and second paper guide paths 46 and 48, respectively. Each of the contact switches 100 and 102 is the same type as the contact switch 86. When a leaf spring 100*a* of the contact switch 100 is depressed by the continuous form paper moved along the first paper guide path 46, the contact switch 100 is turned ON and an output signal thereof is changed from a low level to a high level. Similarly, when a leaf spring 102*a* of the contact switch 102 is depressed by the cut sheet paper moved along the second paper guide path 48, the contact switch 102 is turned ON and an output signal thereof is changed from a low level to a high level. The signals output from the contact switches 100 and 102 are fetched as digital data by the control circuit 82 through analog-to digital (A/D) convertors 106 and 104, respectively.

Figure 7:
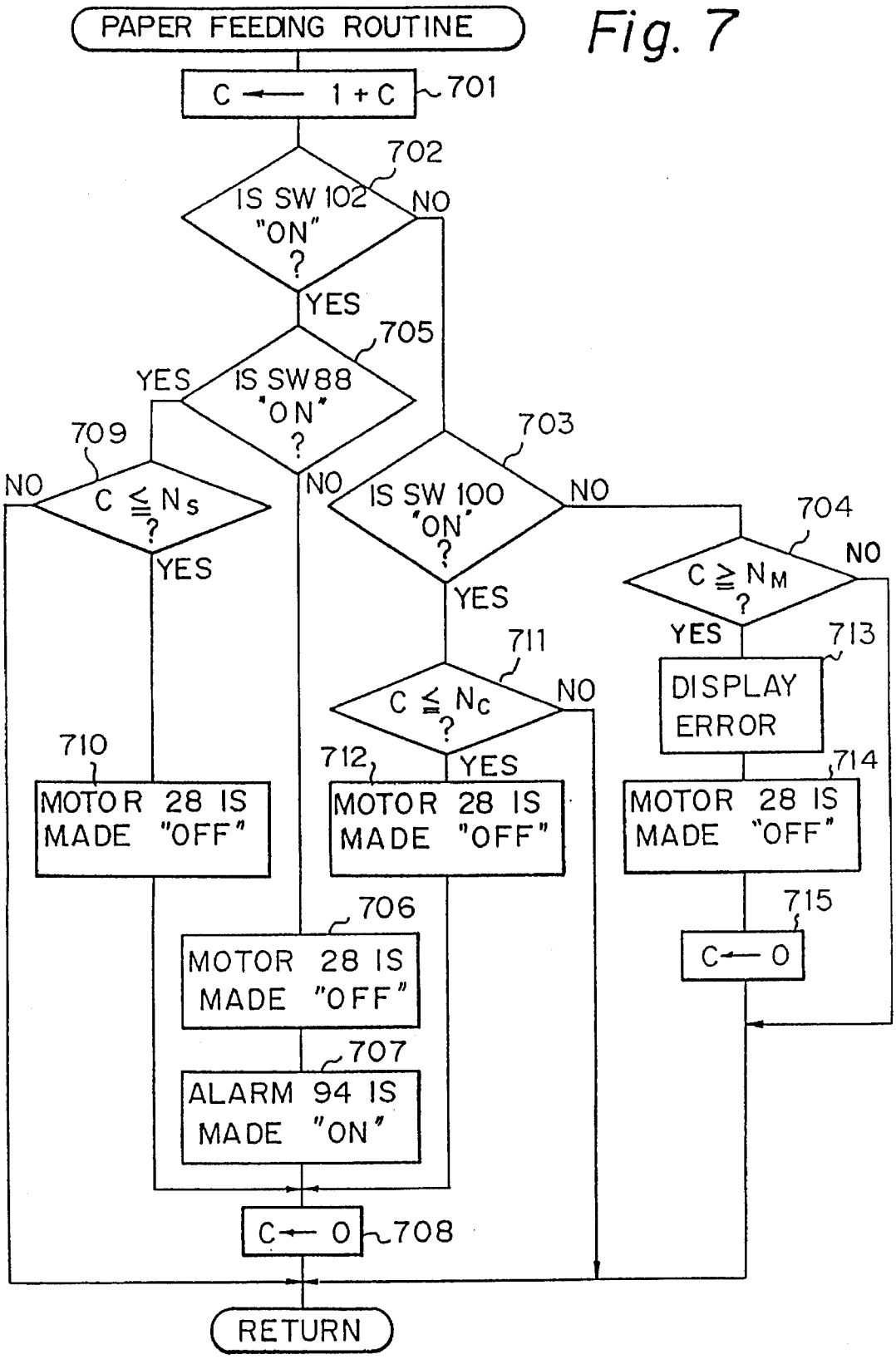
FIG. 7 is a flow chart for explaining an operation of the embodiment shown in FIG. 6.

The operation of the paper feeding apparatus of FIG. 6 will be explained with reference to a paper feeding routine shown in FIG. 7, which may be repeatedly executed in the same manner as that of FIG. 5.

At step 701, a counter C, which is initially made "0", is incremented by 1. Then, at step 702, it is determined whether or not the contact switch 102 is turned ON. If the contact switch 102 is OFF, it is determined that the cut sheet paper can not be detected thereby, and thus the control proceeds to step 703, in which it is determined whether or not the contact switch 100 is turned ON. If the contact switch 100 is OFF, it is determined that the continuous form paper can not be detected thereby, and thus the control proceeds to step 704, in which it is determined whether or not a count number of the counter C has reached a number $N_M$. This number $N_M$ is larger than numbers which correspond to the times elapsing until the leading edges of the continuous form paper and cut sheet paper are detected by the leaf springs 100*a* and 102*a* of the contact switches 100 and 102, respectively. At this stage, since $C<N_M$, the routine is once completed, and thereafter, the routine is repeatedly executed but the counter C is only incremented by 1 until one of the contact switches 102 and 100 is turned ON, i.e., either the cut sheet paper or the continuous form paper is detected thereby.

At step 702, if the contact switch 102 is turned ON, it is determined that the cut sheet paper fed toward the printing position has been detected thereby, and thus the control proceeds to step 705, in which it is determined whether the contact switch 88 is ON or OFF. If the contract switch 88 is OFF, it is determined that the switching lever 74 is at the first position (FIG. 3A) and thus the continuous form paper also may be fed from the pin-belt tractor 50 toward the printing position, resulting in a possible occurrence of a double feeding of the papers. Accordingly, the control proceeds to step 706, in which the driver circuit 84 is de-energized so that the motor 28 is turned OFF, whereby neither the continuous form paper nor the cut sheet paper can be fed to the printing position.

At step 707, the driver circuit 96 is energized so that the alarm 94 is turned ON, whereby the operator is made aware that the proper position (i.e., the second position) of the switching lever 74 has not been selected. The control then proceeds to step 708 in which the counter C is reset, and the routine is ended.

At step 705, if the contact switch 88 is ON, it is determined that the switching lever 74 is at the second position, and that the second paper guide path 48 has been properly selected for a printing of the cut sheet paper. Accordingly, the control proceeds to step 709, in which it is determined whether or not a count number of the counter C reaches a number $N_S$. This number $N_S$ corresponds to a time elapsing until the cut sheet paper reaches the printing position. At this stage, since $C<N_S$, the routine is once completed, and thereafter, the routine is repeatedly executed but the counter C is only incremented by 1 until a count number thereof reaches the number $N_S$.

At step 709, if the count number of the counter C reaches the number $N_S$, i.e., if the cut sheet paper if fed to the printing position, the control proceeds to step 710 in which the motor 28 is turned OFF. The control then proceeds to step 708 in which the counter C is reset, and the routine is ended. Thereafter, a printing routine is executed by, for example, depressing a printing switch on the panel board 10*c*, and a printing of the cut sheet paper is carried out on the basis of image data output from a word processor or a computer.

At step 703, if the contact switch 100 is turned ON, it is determined that the switching lever 74 is at the first position (FIG. 3A) and that the second paper guide path 46 has been properly selected for a printing of the continuous form paper, and thus the control proceeds to step 711, in which it is determined whether or not a count number of the counter C has reached a number $N_C$. This number $N_C$ corresponds to a time elapsing until the continuous form paper reaches the printing position. At this stage, since $C<N_C$, the routine is once completed, and thereafter, the routine is repeatedly executed but the counter C is only incremented by 1 until a count number thereof reaches the number $N_C$.

At step 711, if a count number of the counter C reaches the number $N_C$, i.e., if the continuous form paper is fed to the printing position, the control proceeds to step 712 in which the motor 28 is turned OFF. The control then proceeds to step 708 in which the counter C is reset, and the routine is ended. Thereafter, a printing routine is executed by, for example, depressing a printing switch on the panel board 10*c*, and a printing of the continuous form paper is carried out on the basis of image data output from a word processor or a computer.

At step 704, if a count number of the counter C reaches the number $N_M$, it is determined that the continuous paper has not been in the pin-belt tractor 50, and further, the cut sheet paper has not been introduced into the second guide path 48. Accordingly, the control proceeds to step 713 in which, for example, an error is displayed on a display of the word processor or computer, whereby the operator is made aware that there is no paper to be fed. At step 714, the motor 28 is turned OFF, and the control then proceeds to step 715 in which the counter C is reset, and the routine is ended.

Figure 8:
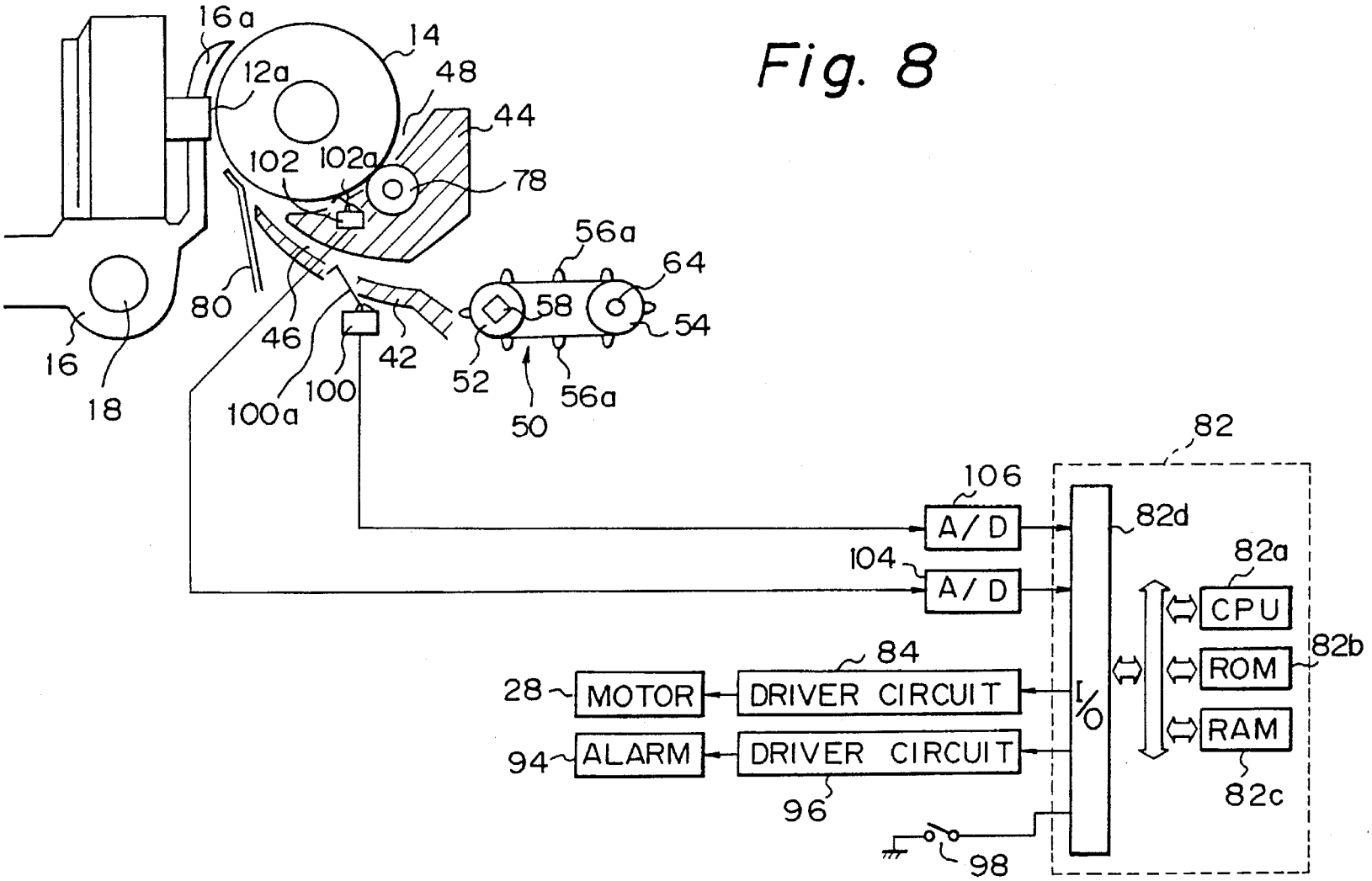
FIG. 8 is a schematic diagram of yet another embodiment of a paper feeding apparatus according to the present invention.

FIG. 8 shows yet another embodiment of the paper feeding apparatus according to the present invention, which is substantially identical to the embodiment of FIG. 2 except that the pin-belt tractor 50 is driven whenever the platen 14 is rotated. Namely, the switching lever 74 and the contact switch 88 are omitted from the embodiment of FIG. 8, and the middle gear 68 is always engaged with the gear 66 and the small gear portion 38*b* of the double gear 36*a*. Accordingly, the continuous form paper must be removed from the pin-belt tractor 50 before the cut sheet paper can be fed to the printing position, to thereby eliminate the occurrence of a double feeding of the papers.

Figure 9:
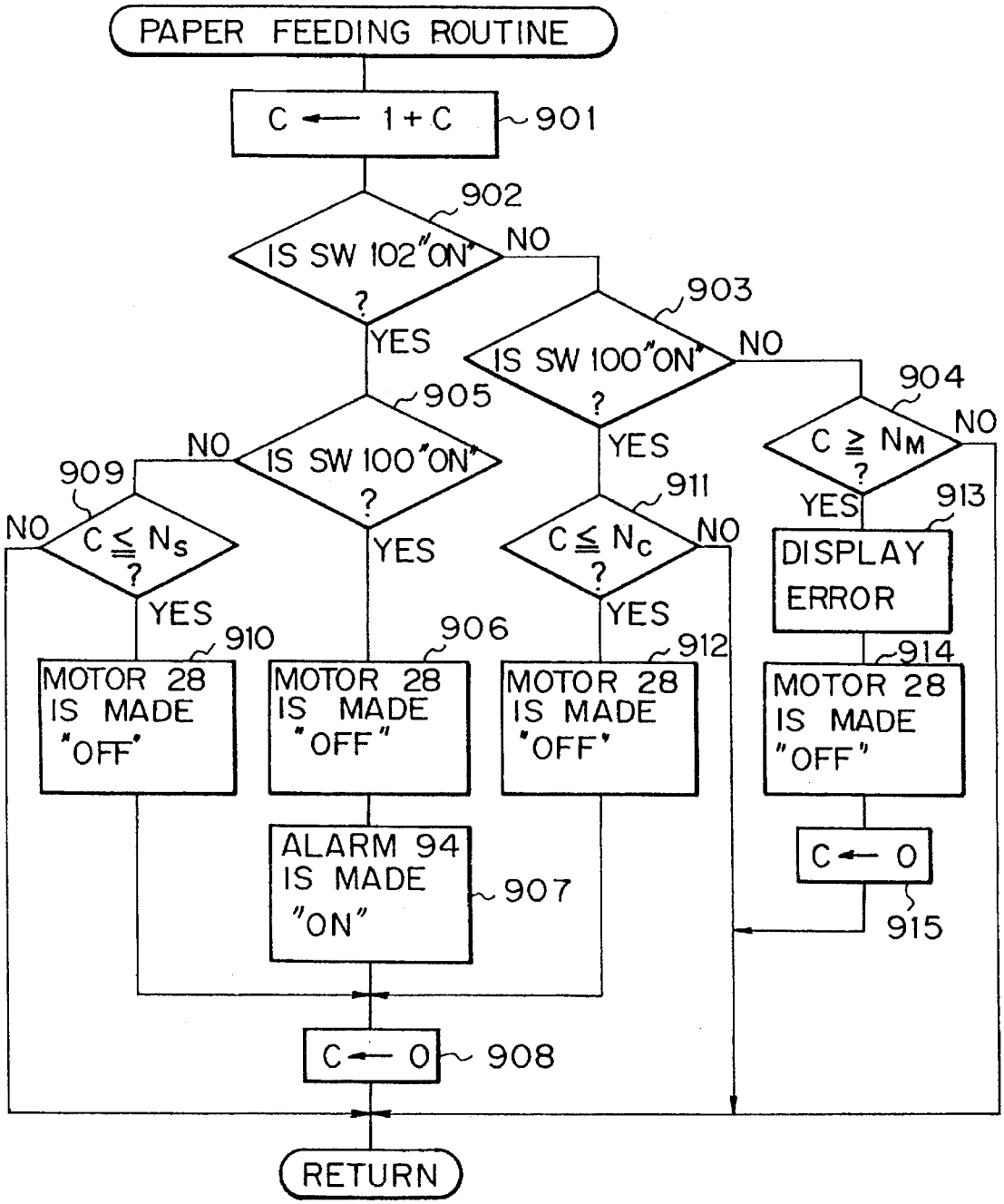
FIG. 9 is a flow chart for explaining an operation of the embodiment in FIG. 8.

The operation of the paper feeding apparatus of FIG. 8 will be explained with reference to a paper feeding routine shown in FIG. 9, which may be repeatedly executed in the same manner as that of FIG. 5.

At step 901, a counter C, which is initially made "0", is incremented by 1. Then, in step 902, it is determined whether or not the contact switch 102 is turned ON. If the contact switch 102 is OFF, it is determined that the cut sheet paper has not been detected thereby, and thus the control proceeds to step 903, in which it is determined whether or not the contact switch 100 is turned ON. If the contact switch 100 is OFF, it is determined that the continuous form paper has not been detected thereby, and thus the control proceeds to step 904, in which it is determined whether or not a count number of the counter C reaches a number $N_M$. This number $N_M$ is larger than numbers which correspond to the times elapsing until the leading edges of the continuous form paper and the cut sheet paper are detected by the leaf springs 100*a* and 102*a* of the contact switches 100 and 102. At this stage, since $C<N_M$, the routine is once completed, and thereafter, the routine is repeatedly executed but the counter C is only incremented by 1 until one of the contact switches 102 and 100 is turned ON, i.e, the cut sheet paper or the continuous form paper is detected thereby.

At step 902, if the contact switch 102 is turned ON, it is determined that the cut sheet paper fed toward the printing position has been detected thereby, and thus the control proceeds to step 905, in which it is determined whether the contact switch 100 is turned ON. If the contact switch 100 is ON, it is determined that the continuous form paper also has been fed from the pin-belt tractor 50, resulting in an occurrence of a double feeding of the papers, and thus the control proceeds to step 906, in which the driver circuit 84 is de-energized so that the motor 28 is turned OFF, whereby neither the continuous form paper nor the cut sheet paper can be fed to the printing position.

At step 907, the driver circuit 96 is energized so that the alarm 94 is turned ON, whereby the operator is made aware that the continuous form paper has not been removed from the pin-belt tractor 50. The control then proceeds to step 908 in which the counter C is reset, and the routine is ended.

At step 905, if the contact switch 100 is OFF, it is determined that the continuous form paper has not been detected thereby, and thus the control proceeds to step 909, in which it is determined whether or not a count number of the counter C reaches a number $N_S$. This number $N_S$ corresponds to a time elapsing until the cut sheet paper reaches the printing position. At this stage, since $C<N_S$, the routine is once completed, and thereafter, the routine is repeatedly executed but the counter C is only incremented by 1 until a count number thereof reaches the number $N_S$.

At step 909, if a count number of the computer C reaches the number $N_S$, i.e., if the cut sheet paper has been fed to the printing position, the control proceeds to step 910 in which the motor 28 is turned OFF. The control then proceeds to step 908 in which the couter C is reset, and the routine is ended. Thereafter, a printing routine is executed by, for example, depressing a printing switch on the panel board 10*c*, and a printing of the cut sheet paper is carried out on the basis of image data output from a word processor or a computer.

At step 903, if the contact switch 100 is turned ON, it is determined that the continuous form paper has been detected thereby, and thus the control proceeds to step 911, in which it is determined whether or not a count number of the counter C reaches a number $N_C$. This number $N_C$ corresponds to a time elapsing until the continuous form paper reaches the printing position. At this stage, since $C<N_C$, the routine is once completed, and thereafter, the routine is repeatedly executed but the counter C is only incremented by 1 until a count number thereof reaches the number $N_C$.

At step 911, if a count number of the counter C reaches the number $N_C$, i.e., if the continuous form paper has been fed to the printing position, the control proceeds to step 912 in which the motor 28 in turned OFF. The control then proceeds to step 908 in which the counter C is reset, and the routine is ended. Thereafter, a printing routine is executed by, for example, depressing a printing switch on the panel board 10*c*, and a printing of the continuous form paper is carried out on the basis of image data output from a word processor or a computer.

At step 904, if a count number of the counter C has reached the number $N_M$, it is determined that the continuous paper has not been set in the pin-belt tractor 50, and further, the cut sheet paper has not been introduced into the second guide path 48. Accordingly, the control proceeds to step 713 in which, for example, an error is displayed on a display of the word processor or computer, whereby the operator is made aware that there is no paper to be fed. At step 914, the motor 28 is turned OFF, and the control proceeds to step 915 in which the counter C is reset, and the routine is ended.

If the above-mentioned embodiments, although the paper feeding apparatus has been explained in connection with the printer, the present invention may be embodied in other equipment or machinery having a paper-processing station to which a paper is selectively fed through paper guide paths.

In the above-mentioned embodiments, a sprocket wheel may be substituted for the pin-belt tractor, to thereby feed the continuous form paper to the printing position.

Also, in the above-mentioned embodiments, although the cut sheet paper is manually introduced into the paper guide path, it may be automatically introduced therein by using a well-known cut sheet feeder.

Finally, it will be understood by those skilled in the art that the foregoing description is of preferred embodiments of the present invention, and that various changes and modifications can be made without departing from the spirit and scope thereof.

I claim:

1. A paper feeding apparatus for selectively feeding at least first and second papers to a paper-processing station through at least a first and a second paper guide path, comprising:

first feeder means for selectively feeding the first paper through said first paper guide path to said paper-processing station;

second feeder means for feeding the second paper through said second paper guide path to said paper-processing station;

selecting means for selecting one of said first feeder means and said second feeder means;

monitor means for monitoring a paper fed by said first and second feeder means to said paper-processing station through said first and second paper guide paths and includes means for generating, in the event of a double feeding of both papers, a signal indicating an occurrence of the double feeding of the papers, wherein said monitor means also monitors whether said first feeder means is selected to feed the first paper through said first paper guide path to said paper-processing station; and alarm means for receiving said signal from said monitor means and warning of the occurrence of the double feeding of the papers on the basis of the signal generated by said monitor means.

2. A paper feeding apparatus as set forth in claim 1, wherein said monitor means comprises:

first signal generation means for generating a signal indicating which of said first and second feeder means is selected for the feeding of the paper;

detection means for detecting the paper fed thereto and for generating a signal indicating a detection of the paper, said detection means detects the first paper fed from said first feeder means at a time different from a time at which said detecting means detects the second paper fed from said second feeder means;

first determination means for determining through which of the first and second guide paths the paper is being fed, on the basis of a comparison of the signal generated by said detection means with a reference time;

second determination means for determining whether or not a determination carried out by said first determination means disagrees with the signal generated by said first signal generation means; and second signal generation means for generating said signal indicating the occurrence of the double feeding of the papers when a disagreement between the determination carried out by said first determination means and the signal generated by said first signal generation means is determined by said second determination means.

3. A paper feeding apparatus as set forth in claim 1, wherein said monitor means comprises:

first signal generation means for generating a signal indicating which of said first and second feeder means is selected for the feeding of the paper;

first detection means associated with said first feeder means for detecting the paper fed thereto, to generate a signal indicating a detection of the paper;

second detection means associated with said second feeder means for detecting the paper fed thereto, to generate a signal indicating a detection of the paper;

determination means for determining whether or not the signal generated by said first signal generation means disagrees with a signal obtained from one of said first and second detection means; and second signal generation means for generating said signal indicating the occurrence of the double feeding of the papers when a disagreement between the signal generated by the one of said first and second detection means and the signal generated by said first signal generation means is determined by said determination means.

4. A printer as set forth in claim 1, further comprising a paper-processing station having at least a first and second paper guide path, and further having a platen and a printing position defined by a printing head and said platen.

5. A printer as set forth in claim 4, wherein said printing position is defined as a gap between said printing head and said platen facing said printing head.

6. A printer as set forth in claim 5, wherein said monitor means comprises;

first signal generation means for generating a signal indicating which of said first and second feeder means is selected for the feeding of the paper;

detection means for detecting the paper fed thereto, at a location between said paper-processing station and a joining location of said first and second paper guide paths, and for generating a signal indicating a detection of the paper, said detection means detects the first paper fed from said first feeder means at a time different from a time at which said detection means detects the second paper fed from said second feeder means;

first determination means for determining through which of the first and second guide paths the paper is being fed on the basis of a comparison of the signal generated by said detection means with a reference time;

second determination means for determining whether or not a determination carried out by said first determination means disagrees with the signal generated by said first signal generation means; and second signal generation means for generating signal signal indicating the occurrence of the double feeding of the papers when a disagreement between the determination carried out by said first determination means and the signal generated by said first signal generation means is determined by said second determination means.

7. A printer as set forth in claim 6, wherein said first paper guide path is defined by a first guide member disposed between said platen and said first feeder means, and wherein said second paper guide path is defined by a second guide member applied to a part of said platen, said second feeder means including a pressure roller pressed against said platen and incorporated in said second guide member.

8. A printer as set forth in claim 7, wherein said detection means comprises a contact switch incorporated into said first guide member.

9. A printer as set forth in claim 8, wherein said first feeder means comprises a pin-belt tractor for feeding a continuous form paper to said printing position, and wherein said second feeder means comprises said pressure roller engaged with said platen to feed a cut sheet paper to said printing position.

10. A printer as set forth in claim 9, wherein said pin-belt tractor and said platen are driven by a common drive motor through a transmission mechanism, wherein said selecting means includes a switching lever associated with said transmission mechanism which selectively cuts off an operative connection between said common drive motor and said pin-belt tractor, said switching lever being movable between a first position whereby the operative connection between said common drive motor and said pin-belt tractor is established and a second position whereby the operative connection between said common drive motor and said pin-belt tractor is cut.

11. A printer as set forth in claim 10, wherein said first signal generation means comprises a contact switch which is arranged so that said contact switch is engageable with said switching lever at only one of said first and second positions thereof.

12. A printer as set forth in claim 5, wherein said monitor means comprises:

first signal generation means for generating a signal indicating which of said first and second feeder mean is selected for the feeding of the paper;

first detection means associated with said first feeder means for detecting the paper fed thereto, to generate a signal indicating a detection of the paper;

second detection means associated with said second feeder means for detecting the paper fed thereto, to generate a signal indicating a detection of the paper;

determination means for determining whether or not the signal generated by said first signal generation means disagrees with said signal obtained from one of said first and second detection means; and second signal generation means for generating said signal indicating the occurrence of the double feeding of the papers when a disagreement between the signal generated by the one of said first and second detection means and the signal generated by said first signal generation means is determined by said determination means.

13. A printer as set forth in claim 12, wherein said first paper guide path is defined by a first guide member disposed between said platen and said first feeder means, and wherein said second paper guide path is defined by a second guide member applied to a part of said platen, said second feeder means including a pressure roller pressed against said platen and incorporated in said second guide member. associated with said second guide member.

14. A printer as set forth in claim 13, wherein said first detection means comprises a contact switch associated with said first guide member, and wherein said second detection means comprises a contact switch associated with said second guide member at a location downstream from said second feeder means.

15. A printer as set forth in claim 14, wherein said first feeder means comprises a pin-belt tractor for feeding a continuous form paper to said printing position, and wherein said second feeder means comprises said pressure roller engaged with said platen to feed a cut sheet paper to said printing position.

16. A printer as set forth in claim 15, wherein said pin-belt tractor and said platen are driven by a common drive motor through a transmission mechanism, wherein said selecting means includes a switching lever associated with said transmission mechanism which selectively cuts off an operative connection between said common drive motor and said pin-belt tractor, said switching lever being movable between a first position whereby the operative connection between said common drive motor and said pin-belt tractor is established and a second position whereby the operative connection between said common drive motor and said pin-belt tractor is cut.

17. A printer as set forth in claim 16, wherein said first signal generation means comprises a contact switch which is arranged so that said contact switch is engageable with said switching lever at only one of said first and second positions thereof.

18. A paper feeding method of selectively feeding papers through at least a first paper guide path by a first feeder means and a second paper guide path by a second feeder means to a paper-processing station, comprising the steps of:

selecting one of said first feeder means and said second feeder means;

monitoring the respective papers fed through said first and second paper guide paths to said paper-processing station;

generating, in the event of a double feeding of both papers, a double feed signal indicating an occurrence of the double feeding of the papers, wherein said monitoring step further includes the step of monitoring whether said first feeder means has been selected to feed papers to said paper-processing station; and raising an alarm warning of the occurrence of the double feeding of the papers on the basis of the double feeding signal.

19. A paper feeding method as set forth in claim 18, wherein said monitoring step comprises the sub-steps of:

generating a guide path selection signal indicating which of said first and second feeder means is selected for the feeding of the paper;

detecting the respective papers fed through said first and second paper guide paths, at a location between said paper-processing station and a joining location of said first and second paper guide paths;

generating a detection signal indicating a detection of the paper, the paper fed through said first paper guide path being detected at a time different from a time at which the paper fed through said second paper guide path is detected;

determining through which of the first and second guide paths the paper is being fed, on the basis of a comparison of said detection signal with a reference time;

determining whether or not a determination result made in the determining sub-step disagrees with said guide path selection signal; and generating said double feeding signal when a disagreement between said determination result and said detection signal is determined.

20. A paper feeding method as set forth in claim 18, wherein said monitoring step comprises the sub-steps of:

generating a guide path selection signal indicating which of said first and second feeder means is selected for the feeding of the paper;

detecting the paper fed through said first paper guide path, to generate a signal indicating a detection of the paper;

detecting the paper fed through second paper guide path, to generate a signal indicating a detection of the paper;

determining whether or not said guide path selection signal disagrees with the detection signal obtained in one of the sub-step of detecting the paper fed through said first paper guide path and the sub-step of detecting the paper fed through said second paper guide path; and generating said double feeding signal when a disagreement between said guide path selection signal and said detection signal is determined in the preceding sub-step.

21. A paper feeding method as set forth in claim 18, wherein said monitoring step comprises the sub-steps of:

detecting the paper fed through said first paper guide path, to generate a detection signal indicating a detection of the paper;

detecting the paper fed through second paper guide path, to generate a detection signal indicating a detection of the paper;

determining whether or not respective detection signals are generated in the preceding first and second sub-steps; and generating said double feeding signal when the generation of the respective detection signals is determined in the preceding sub-step.

22. A paper feeding apparatus for selectively feeding at least first and second papers to a paper-processing station through at least a first and second paper guide path, comprising:

first feeder means for selectively feeding the first paper through said first paper guide path to said paper-processing station;

second feeder means for feeding the second paper through said second guide path to said paper-processing station;

first detection means associated with said first feeder means for detecting the paper fed thereto, to generate a signal indicating a detection of the paper;

second detection means associated with said second feeder means for detecting the paper fed thereto, to generate a signal indicating a detection of the paper;

determination means for determining whether or not a signal is generated by each of said first and second detection means;

signal generation means for generating a signal indicating an occurrence of a double feeding of both papers when the generation of the signal by said first and second detection means is determined by said determination means; and alarm means for receiving said signal from said signal generation means and warning of the occurrence of the double feeding of the papers on the basis of the signal generated by said signal generation means.

23. A paper feeding apparatus for selectively feeding at least first and second papers to a printing position through at least a first and second paper guide path, comprising:

a printing head and a platen defining a gap therebetween;

first feeder means for selectively feeding the first paper through said first paper guide path to said printing position;

second feeder means for feeding the second paper through said second guide path to said printing position;

first detection means associated with said first feeder means for detecting the paper fed thereto, to generate a signal indicating a detection of the paper;

second detection means associated with said second feeder means for detecting the paper fed thereto, to generate a signal indicating a detection of the paper;

determination means for determining whether or not a signal is generated by each of said first and second detection means;

signal generation means for generating a signal indicating an occurrence of a double feeding of both papers when the generation of the signal by said first and second detection means is determined by said determination means; and alarm means for receiving said signal from said signal generation means and warning of the occurrence of the double feeding of the papers on the basis of the signal generated by said signal generation means.

24. A printer as set forth in claim 23, wherein said first paper guide path is defined by a first guide member disposed between said platen and said first feeder means, and wherein said second paper guide path is defined by a second guide member applied to a part of said platen, said second feeder means including a pressure roller pressed against said platen and incorporated in said second guide member.

25. A printer as set forth in claim 24, wherein said first detection means comprises a contact switch associated with said first guide member, and wherein said second detection means comprises a contact switch associated with said second guide member at a location downstream from said second feeder means.

26. A printer as set forth in claim 25, wherein said first feeder means comprises a pin-belt tractor for feeding a continuous form paper to said printing position, and wherein said second feeder means comprises said pressure roller engaged with said platen to feed a cut sheet paper to said printing position.

27. A printer as set forth in claim 26, wherein said pin-belt tractor and said platen are driven by a common drive motor through a transmission mechanism.

* * * * *